United States Patent [19]

Tachibana et al.

[11] 4,295,792

[45] Oct. 20, 1981

[54] APPARATUS FOR CONTROLLING OPERATION OF FLUID PRESSURE RAISING SYSTEM

[75] Inventors: Keiji Tachibana, Tokyo; Yoshihiko Nakayama, Shimoinayoshi; Junichi Kaneko, Amimachi; Susumu Ishii, Tsuchiura, all of Japan

[73] Assignee: Hitachi, Ltd., Tokyo, Japan

[21] Appl. No.: 937,806

[22] Filed: Aug. 29, 1978

[30] Foreign Application Priority Data

Sep. 9, 1977 [JP] Japan ..... 52-107830

[51] Int. Cl.[3] ..... F04B 49/00; F16D 25/063

[52] U.S. Cl. ..... 417/15; 62/228; 192/87.18

[58] Field of Search ..... 417/15, 316, 223; 62/228 B, 228 C, 229; 74/325, 335, 336, 337, 346; 192/87.15, 87.18, 87.19, 82 R, 85 R

[56] References Cited

U.S. PATENT DOCUMENTS

| | | | |
|---|---|---|---|
| 823,118 | 6/1906 | Gurney | 417/15 |
| 2,317,135 | 4/1943 | Crittenden et al. | 417/15 |
| 2,464,538 | 3/1949 | Vanderzee | 192/87.18 X |
| 3,155,040 | 11/1964 | Shurts et al. | 192/85 R X |
| 3,352,392 | 11/1967 | Black et al. | 192/87.19 X |
| 3,417,845 | 12/1968 | Swanson | 192/87.19 |
| 3,455,118 | 7/1969 | Petranek | 62/229 X |
| 4,006,603 | 2/1977 | Miles | 62/229 |

FOREIGN PATENT DOCUMENTS

| | | | |
|---|---|---|---|
| 525902 | 6/1956 | Canada | 417/15 |
| 503618 | 4/1970 | Fed. Rep. of Germany | 417/15 |
| 49-21332 | 5/1974 | Japan . | |
| 52-18942 | 5/1977 | Japan . | |

*Primary Examiner*—Carlton R. Croyle
*Assistant Examiner*—Edward Look
*Attorney, Agent, or Firm*—Craig and Antonelli

[57] ABSTRACT

An apparatus for controlling the operation of a fluid pressure raising system having a motor and a centrifugal fluid machine adapted to be driven by the motor. The apparatus has an overdrive gear disposed between the motor, which is typically an electric motor suited for the commercially available electric power, and the centrifugal fluid machine. The overdrive gear consists of two gear trains or pairs having different overdrive ratios, each consisting of a gear and a pinion meshing with the gear, and a clutch adapted to selectively switch over the gear pair taking part in the torque transmission between the output shaft of the motor and the impeller shaft of the centrifugal fluid machine, from one gear pair to the other gear pair and vice versa. Thus, the overdrive gear can transmit the power of the motor to the impeller at two different overdrive ratios. The clutch is adapted to be actuated in response to a signal representative of an external condition of the fluid pressure raising system, which signal is delivered by a detector.

25 Claims, 8 Drawing Figures

APPARATUS FOR CONTROLLING OPERATION OF FLUID PRESSURE RAISING SYSTEM

BACKGROUND OF THE INVENTION

1. Field of the Invention

The present invention relates to an apparatus for controlling the operation of a fluid pressure raising system including at least a motor and a fluid machine adapted to be driven by the motor, such as a turbocompressor for refrigerator, centrifugal compressor for pressurizing gases, centrifugal blower and the like.

2. Description of the Prior Art

Japanese patent publication No. 21332/74 to Shoji Ichikawa and Japanese patent publication No. 18942 to Shuichi Takada et al. are cited as showing prior art.

Referring first to Japanese patent publication No. 21332/74, there is disclosed a turbo-refrigerator having a turbo-compressor, a motor for driving the compressor, a condenser adapted to condense the refrigerant, and expansion or reducing valve for releasing the pressurized and liquefied refrigerant coming from the condenser, an evaporator adapted to allow the liquefied refrigerant released by the expansion valve to evaporate, suction vanes disposed in the suction-side passage of the compressor and so forth. In this turbo-refrigerator, the motor for driving the compressor is a high-speed D.C. motor or a thyristor motor connected to a D.C. power supply through a speed controller such as a variable resistor or a thyristor chopper. This speed controller is adapted to control the speed of rotation of the impeller of the turbo-compressor in accordance with the temperature differential between the evaporatoroutlet brine temperature and the condenser-inlet cooling water temperature.

The speed control of the turbo-compressor in accordance with the above mentioned temperature differential or the change of the cooling water temperature makes it possible to minimize the required electric input power and, therefore, greatly contribute to save the energy.

The above explained refrigerator, however, requires an uneconomically large equipment for the speed control, because it relies upon a high-speed D.C. motor, D.C. power supply and speed controller constituted by a variable resistor or a thyristor chopper, and a stupendous installation cost. One of the factors for raising the cost resides in the indispensableness of an AC-DC convertor, i.e. a D.C. motor generator, for converting the commercially available A.C. power to D.C. power.

Referring now to Japanese patent publication No. 18942/77, there is disclosed a turbo-refrigerator having a turbo-compressor, a prime mover for driving the turbo-compressor, a condenser adapted to condense the refrigerant compressed by the turbo-compressor, and a cooler for cooling the refrigerant flowing into the compressor. The speed of the prime mover is adjusted by a governor which is adapted to be controlled in accordance with the flow rate of cooling fluid for cooling the condenser or the pressure of the refrigerant in the condenser which is detected by a specific detector. This turbo-refrigerator can ensure the same advantageous effect as that provided by the refrigerator of the first-mentioned Japanese patent publication No. 21332/74.

The prime mover of this refrigerator for driving the turbo-compressor is a steam turbine, highfrequency electric motor or the like. However, the increment of the size and cost of the controlling equipment cannot be avoided whichever may be used as the prime mover. At the same time, the use of a steam turbine, which inherently has a low efficiency, inconveniently lowers the efficiency of the refrigerator as a whole and demonstrates the need for increasing the efficiency of the turbo-compressor as, for example, by improvement in the speed control.

Thus, the prior art poses new problems to be solved: to simplify the construction of the speedcontrolling equipment and to lower the costs of manufacture and installation.

SUMMARY OF THE INVENTION

It is therefore an object of the invention to provide an apparatus for controlling the operation of a fluid pressure raising system, in which the construction of equipment for controlling the speed of rotation of a fluid machine of the system is simplified.

It is another object of the invention to provide an apparatus for controlling the operation of a fluid pressure raising system, having a less expensive equipment for controlling the speed of rotation of a fluid machine of the system.

It is still another object of the invention to provide an apparatus for controlling the operation of a fluid pressure raising system including a centrifugal fluid machine, which affords an easy modification of the centrifugal fluid machine to make the latter suit for a free speed control.

To this end, according to the invention, there is provided apparatus for controlling the operation of a fluid pressure raising system including at least a motor and a fluid machine connected to the motor, the fluid machine including a casing provided with a suction passage and a discharge passage in communication with the suction passage, inlet guide vanes disposed in the suction passage, an impeller shaft connected to the motor and rotatably mounted in the casing and at least one impeller carried by the impeller shaft, so that a fluid may be sucked through the suction passage and pressurized by the impeller as the impeller is driven by the motor and then discharged through the discharge passage, the apparatus comprising: an overdrive gear having a variable overdrive ratio and disposed between the motor and the fluid machine, the overdrive gear including a gear box, a driven shaft connected to the impeller shaft of the fluid machine and rotatably carried by the gear box, at least two pinions having different numbers of gear teeth and carried by the driven shaft, a drive shaft extending substantially in parallel with the driven shaft and rotatably carried by the gear box, the drive shaft being connected to the shaft of the motor, gears rotatably carried by the drive shaft and adapted to engage corresponding one of the pinions, and clutch means adapted to connect a selected one of the gears to the drive shaft, whereby the driven shaft is rotated at at least two overdrive ratios of a set overdrive ratio and a low overspeed ratio; detecting means for detecting external condition of the fluid pressure raising system and to produce a signal representative of the external condition; and an actuator for actuating the clutch means in response to the signal delivered by the detecting means.

These and other objects, as well as advantageous features of the invention will become clear from the following descriptions of the preferred embodiments taken in conjunction with the accompanying drawings.

DESCRIPTION OF THE PREFERRED EMBODIMENTS

Figure 1:
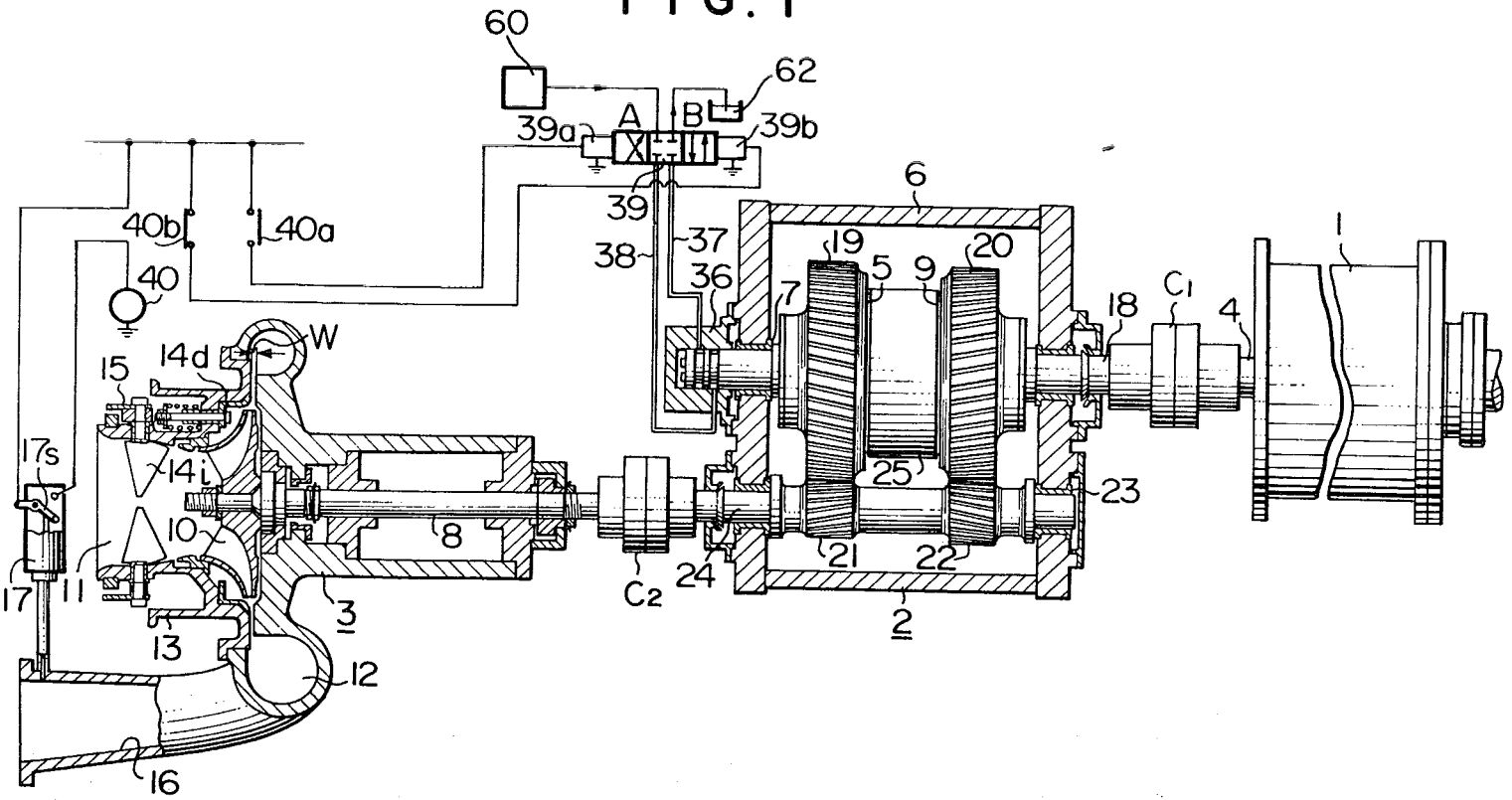
FIG. 1 is a fragmentary schematic sectional view of an apparatus in accordance with the invention for controlling the operation of a fluid pressure raising system including a motor and a centrifugal compressor adapted to be driven by the motor.

Referring first to FIG. 1, a fluid pressure raising system has a motor 1 and a centrifugal fluid machine 3 which is, in this embodiment, a centrifugal or turbo compressor. The motor 1 may be a commercially available three-phase induction motor preferably having a constant rated speed.

An apparatus in accordance with the invention for controlling the operation of the fluid pressure raising system has an overdrive gear 2 disposed between the motor 1 and the compressor 3 and a detector 17 adapted to detect the pressure in the discharge passage 16 of the compressor 3. The overdrive gear 2 is adapted to be controlled in accordance with the pressure detected by the detector 17.

More specifically, the overdrive gear 2 is provided with a gear box 6, a drive shaft 18 connected through a coupling C1 to the output shaft 4 of the motor 1 and rotatably carried by the gear box through bearings 7, two gears 19, 20 rotatably mounted on the drive shaft 18 through bearings, and a driven shaft 24 having mounted thereon pinions 21, 22 meshing with the gears 19, 20, respectively, the driven shaft 24 being carried by the gear box through a bearing 23 and connected to the impeller shaft 8 of the compressor 3 through a coupling C2.

The overdrive ratio (referred to as "set over-drive ratio") provided by the meshing of the gear 19 with the pinion 21 is selected to be greater than the overdrive ratio (referred to as "low overdrive ratio") provided by the meshing of the gear 20 with the pinion 22.

A clutch 5 is disposed between the gears 19 and 20, for bringing the gear 19 into and out of engagement with the drive shaft 18. Another clutch 9 disposed also between the gears 19 and 20 is adapted to bring the gear 20 into and out of engagement with the drive shaft 18.

Figure 2:
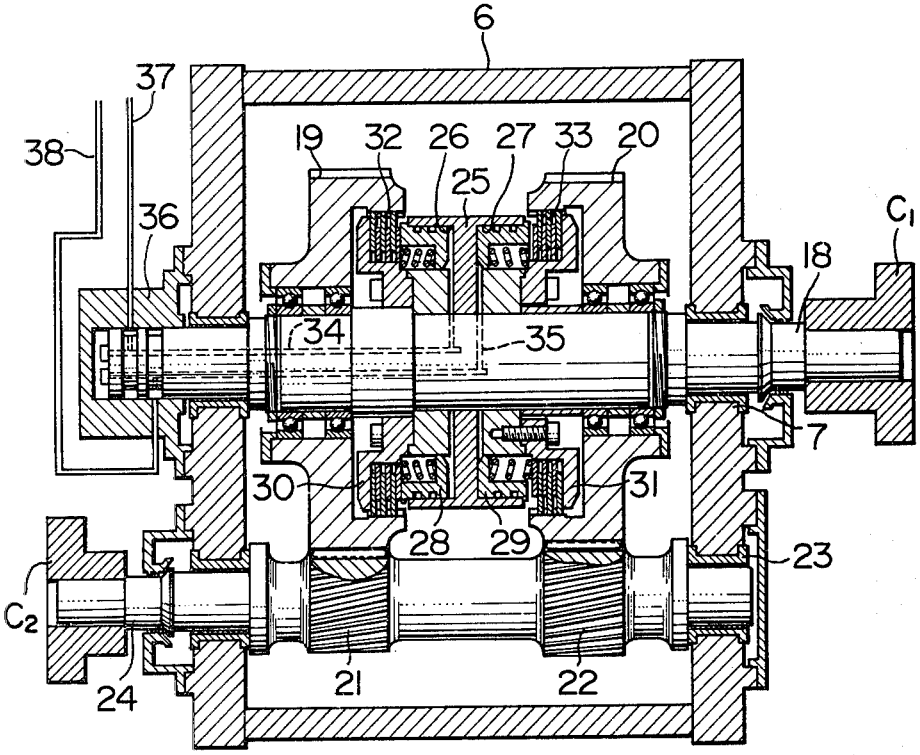
FIG. 2 is an enlarged sectional view of an overdrive gear incorporated in the apparatus as shown in FIG. 1.
Figure 3:
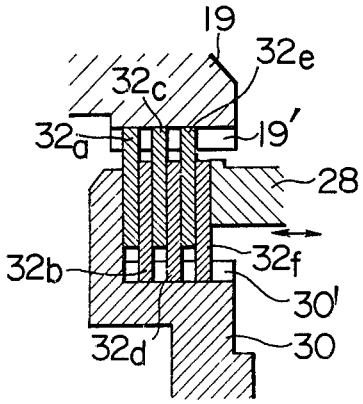
FIG. 3 is an enlarged sectional view of a clutch of the overdrive gear as shown in FIG. 2.

Referring now to FIGS. 2 and 3 showing the constructions of the clutches 5 and 9 in detail, a drive disc 25 is fixed to a portion of the drive shaft 18 between the gears 19, 20, so as to be rotated and stopped together with the drive shaft 18.

The drive disc 25 is provided at its sides confronting the gears 19 and 20 with ring-shaped cylinders 26, 27. These ring-shaped cylinders 26, 27 receive respective ring-shaped pistons 28, 29. End members 30, 31 are connected to the inner peripheral sides of the driving disc 25 at respective sides of the latter. Between the end member 30 and the piston 28, disposed are six doughnut-shaped discs **32*a* to 32*f*. Similarly, six doughnut-shaped discs 33*a* to 33*f* are disposed between the end member 31 and the piston 29**.

As will be most clearly seen from FIG. 3, three discs **32*a*, 32*c* and 32*e* out of six engage at their outer peripheries spline grooves 19' formed in the inner peripheral wall of the gear 19, so as to be rotated unitarily with the gear 19. Meanwhile, the remaining three discs 32*b*, 32*d* and 32*f* are in engagement at their inner peripheries with spline grooves 30' formed on the outer peripheral surface of the end member 30, so as to be rotated unitarily with the drive disc 25. These six discs 32*a*, 32*b*, 32*c*, 32*d*, 32*e* and 32*f*** are disposed in the mentioned order.

The six doughnut-shaped discs **33*a* to 33*f* for the gear 20 are arranged in the same manner as those 32*a* to 32*f* for the gear 19**.

The controlling apparatus of the invention further includes an actuator for actuating the clutches 5, 9 in accordance with the signal delivered by the detector 17. The actuator includes an oil passage 34 leading to the inside of the cylinder 26, adapted for charging and discharging the working oil, and a similar oil passage 35 leading to the inside of the cylinder 27. These oil passages are formed in the drive shaft 18. The actuator further includes oil pipes 37, 38 connected to the ends of the oil passages 34, 35, respectively, through an oil supplying member 36, a solenoid-actuated four-way valve 39, a pressurized oil source, and an oil tank 62 connected to the four way valve 39, and a relay 40 electrically connected to the solenoid of the four way valve 39 and adapted to be operated by closing and opening of a contact 17S of a pressure detector 17. The relay 40 has a normally-opened contact **40*a* and a normally-closed contact 40*b***.

The overdrive gear 2 is connected to the output shaft 4 of the motor 1 through the coupling C1, while the overdrive gear 2 in turn is connected to the compressor 3 through the coupling C2, as stated before. The motor 1, overdrive gear 2 and the compressor 3 are situated on a common bed which is not shown.

The compressor 3 has an impeller shaft 8, an impeller 10 fixed to the impeller shaft 8, a casing 13 encasing the impeller 10 and forming a suction passage 11 and a volute chamber 12, movable inlet vanes **14*a* disposed in the suction passage 11, movable diffusers 14*d* disposed at the downstream side of the impeller 10, and a driving mechanism 15 for driving the movable vanes 14*i* and the movable diffusers 14*d***.

As the impeller 10 is rotated, gas is induced and sucked through the suction passage 11, and is accelerated by the impeller 10 to rush into the volute chamber 12. The kinetic energy possessed by the accelerated gas is then changed into a pressure, in the volute chamber 12.

The flow rate of the gas can be changed by changing the strength of the swirl imparted by the movable inlet vanes **14*i*. More specifically, the stronger the swirl is made, the smaller the flow rate becomes. The movable diffusers 14***d* are operatively connected to the movable inlet vanes 14*i*, such that they are moved to make the diffuser width w smaller, when the flow rate is smaller than a predetermined threshold.

The aforementioned pressure detector 17 is attached to a discharge pipe 16 connected to the downstream-side end of the volute chamber 12, so as to detect the pressure of the pressurized gas delivered by the compressor 3. The contact 17S of the pressure detector 17 is adapted to be closed when a predetermined gas pressure is reached.

Hereinafter, the operation of the apparatus of this embodiment will be described. At the period soon after the startup of the compressor in which the discharge pressure is still low, the contact 17S of the pressure detector 17 is kept opened, so that the relay 40 is not energized. Consequently, the normally-closed contact 40*b* of the relay 40 is kept closed to allow the energization of the solenoid coil 39*b* of the four way valve 39. In this state, the four way valve 39 is switched to form a passage as denoted by B, so that the working oil coming from the pressurized oil source 60 is delivered to the cylinder 27, through the pipe 38, oil supplying member 36 and the oil passage 35. As a result, the piston 29 is driven outward, so that the discs 33 come to be tightly sandwiched between the piston 29 and the end member 31. Consequently, the discs 33 are brought into mutual contact, so as to mechanically interconnect the driving disc 25 and the gear 20 in torque-transmitting relation.

In this state, the torque of the output shaft 4 of the motor 1 is transmitted to the compressor 3, through the coupling C1, drive shaft 18, drive disc 25, discs 33, gear 20, pinion 22, driven shaft 24 and the coupling C2, so that the impeller 10 is driven at the low overdrive ratio.

Then, as the discharge pressure comes up to the level of a predetermined threshold, the contact 17S is closed to allow the relay 40 to be energized, so that the normally-opened contact 40*a* is closed while the normally-closed contact 40*b* is opened. As the normally-opened contact 40*a* is closed, another solenoid coil 39*a* of the four way valve 39 is energized to switch the latter, so as to form an oil passage as denoted by A. The oil coming from the pressurized oil source 60 is therefore delivered to the cylinder 26, through the pipe 37, oil supplying member 36 and the oil passage 34.

Consequently, the piston 28 is driven outward, so as to come into cooperation with the end member 30 in firmly gripping the discs 32 therebetween, thereby to connect the drive disc 25 to the gear 19 in torque-transmitting relation. The torque of the output shaft 4 of the motor 1 is therefore transmitted to the compressor 3, through the coupling C1, drive shaft 18, drive disc 25, discs 32, gear 19, pinion 21, driven shaft 24 and the coupling C2, so that the impeller 10 is driven at the set overdrive ratio.

Thus, as the predetermined threshold is reached by the discharge pressure from the compressor operated at the low overdrive ratio, the contact 17S of the pressure detector 17 is closed to disengage and engage the clutches 5 and 9, respectively. In this transient state, there is an instant at which no torque is transmitted to the impeller. This inconveniently causes a repeated opening and closing of the contact 17S, i.e. a hunting of the system.

Figure 4:
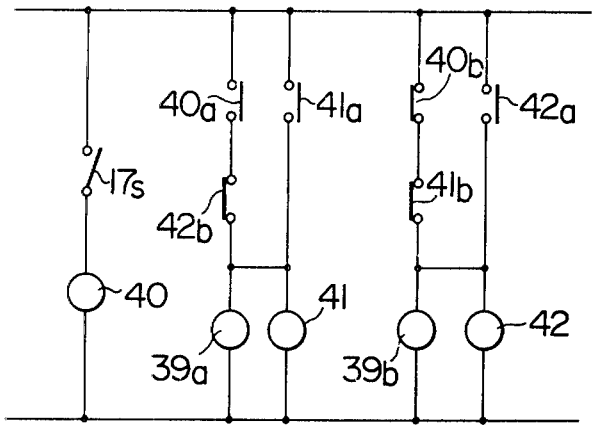
FIG. 4 shows a circuit for suppressing the fluttering of a detector.

This undesirable hunting of the system can be avoided by using a circuit as shown in FIG. 4. Referring to FIG. 4, a timer 41 is adapted to be energized simultaneously with the energization of one of the solenoid coils 39*a* of the four way valve 39, and to hold the energized state for a predetermined time length. Another timer 42 is adapted to be energized simultaneously with the energization of the other of solenoid coils 39*b* of the four way valve 39. The timer 41 has an instantaneous normally-closed contact 41*b* which is series-connected between the normally closed contact 40*b* and the solenoid coil 39*b*. On the other hand, the timer 42 has an instantaneous normally-closed contact 42*b* connected in series to the normally-opened contact 40*a* which is turn is connected in series to the power supply. The timer 41 further has an instantaneous normally-opened contact 41*a* which is connected in parallel with the seriesconnected normally-opened contact 40*a* and the instantaneous normally-closed contact 42*b*. The instantaneous normally-closed contact 42*b* of the timer 42 is connected in series between the normally-opened contact 40*a* and the solenoid coil 39*a*. The timer 42 further has an instantaneous normally-opened contact 42*a* connected in parallel with the series-connected contact 40*b* and the instantaneous normally-closed contact 41*b* which are put in series to the power supply.

When the pressure ratio of the system, i.e. the discharge pressure of the compressor working at the set overdrive ratio happens to come down due to the change of the load or the like, the contact 17S of the pressure detector 17 is opened to switch the operation mode again to the operation at the low overdrive ratio. However, if the gas flow rate demand in this state is still so large as could never be satisfied by the operation of the compressor at the low overdrive ratio, even with the full-opening of the vanes 14*i*, the switching of the operation mode to the low overdrive ratio should not be allowed. Thus, it is necessary to provide a suitable means which prevents the switching of the operation mode in such a situation. Alternatively, it is suggested to allow the switching of the operation mode to the low overdrive ratio operation, on condition that such an additional compressor as would exhibit the highest efficiency at a lower pressure ratio is provided.

Figure 5:
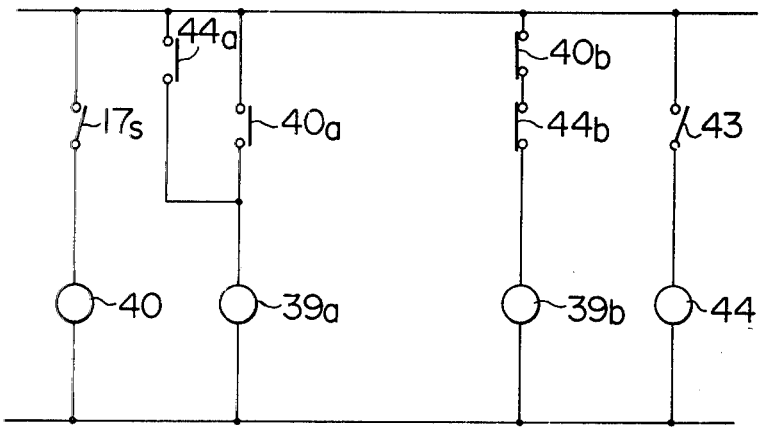
FIG. 5 shows a circuit adapted to prevent the overdrive gear operated at a set overdrive ratio from being switched to a lower overdrive ratio, when it is judged at a predetermined instant of the switching that the air flow-rate demand is still large.

FIG. 5 shows an example of the circuit for preventing the switching of the operation mode to the low overdrive ratio operation when the flow rate demand is still high.

A switch 43 is adapted to be kept closed when the opening degree of the vanes 14*i* at the set overdrive ratio operation is between the full-opening and an opening corresponding to the flow rate attained by the low overdrive ratio operation of the compressor with the vanes 14*i* fully opened, i.e. when the present flow rate demand is so large as could never be met by the low overdrive ratio operation of the compressor. The switch 43 is kept opened in other situation than stated above. A relay 44 connected to the power supply is adapted to be operated in accordance with the status of the switch 43. The relay 44 has a normally-opened contact 44*a* and a normally-closed contact 44*b*. The normally-opened contact 44*a* is connected in parallel with the normally-opened contact 40*a* of the relay 40, while the normally-closed contact 44*b* is connected series to the normally-closed contact 40*b* of the relay 40 and the solenoid coil 39*b*.

Figure 6:
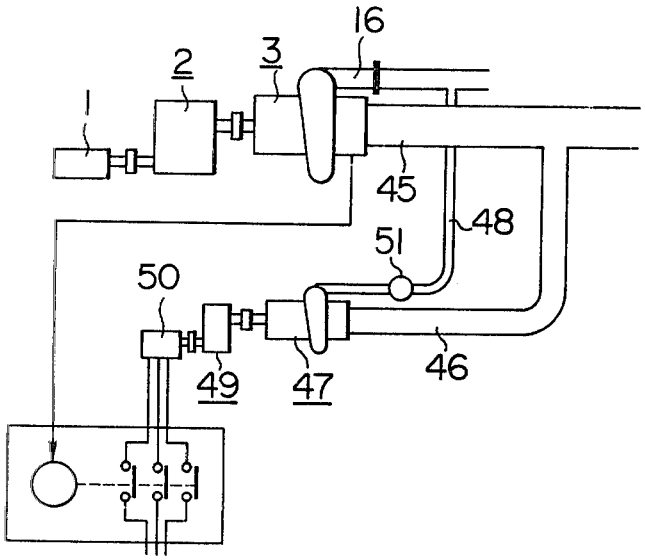
FIG. 6 is a schematic illustration of a fluid pressure raising system having an additional compressor of a low pressure ratio used in place of the circuit as shown in FIG. 5.

FIG. 6 shows an arrangement having an additional compressor suited for smaller pressure ratio. Referring to FIG. 6, the additional compressor 47 suited for smaller pressure ratio (set to meet the required pressure ratio) is connected to a pipe 46 shunting from the suction pipe 45 of the compressor 3. The additional compressor 47 has a discharge pipe 48 connected to the discharge pipe 16 of the compressor 3. The impeller shaft of the additional compressor 47 is connected to an electric motor 50 through an overdrive gear 49. A check valve 51 is disposed in the discharge pipe of the additional compressor 47.

Figure 7:
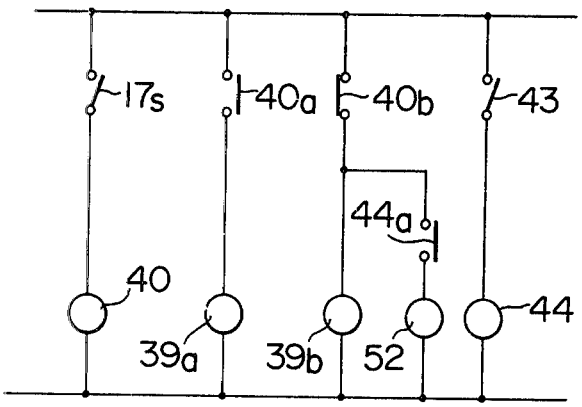
FIG. 7 is an illustration of a circuit adapted for controlling the start and stop of the additional compressor as shown in FIG. 6.

Referring now to FIG. 7 showing an example of a circuit for controlling the start and stop of the additional compressor 47, a relay 52 adapted to actuate a magnet contact for starting and stopping the motor 50 is connected in series to a normally-opened contact 44*a* of a relay 44 which is adapted to be operated in accordance with the status of the switch 43 adapted to be opened and closed depending on the opening degree of the vanes 14*i*. The series-connected relay 52 and the normally-opened contact 44*a* are connected in parallel with the solenoid coil 39*b* which in turn is connected to the power supply. According to this circuit arrangement, provided that the normally-closed contact 40*b* is closed to operate the compressor at the low overdrive ratio, and that the switch 43 is closed to keep the normally-opened contact 44*a* closed, i.e. that the opening degree of the vanes is between the full-opening and the opening degree in set overdrive ratio operation corresponding to the flow rate of the gas attained by full-vane opening operation at the low overdrive ratio, the relay 52 is energized to start the motor 50, thereby to start the additional compressor 47. Thus, the reduction of the flow rate of gas attributable to the switching of the compressor 3 to the low overdrive ratio operation can fairly be compensated by the effort of the additional compressor 47 taking part in the compression of the gas.

Figure 8:
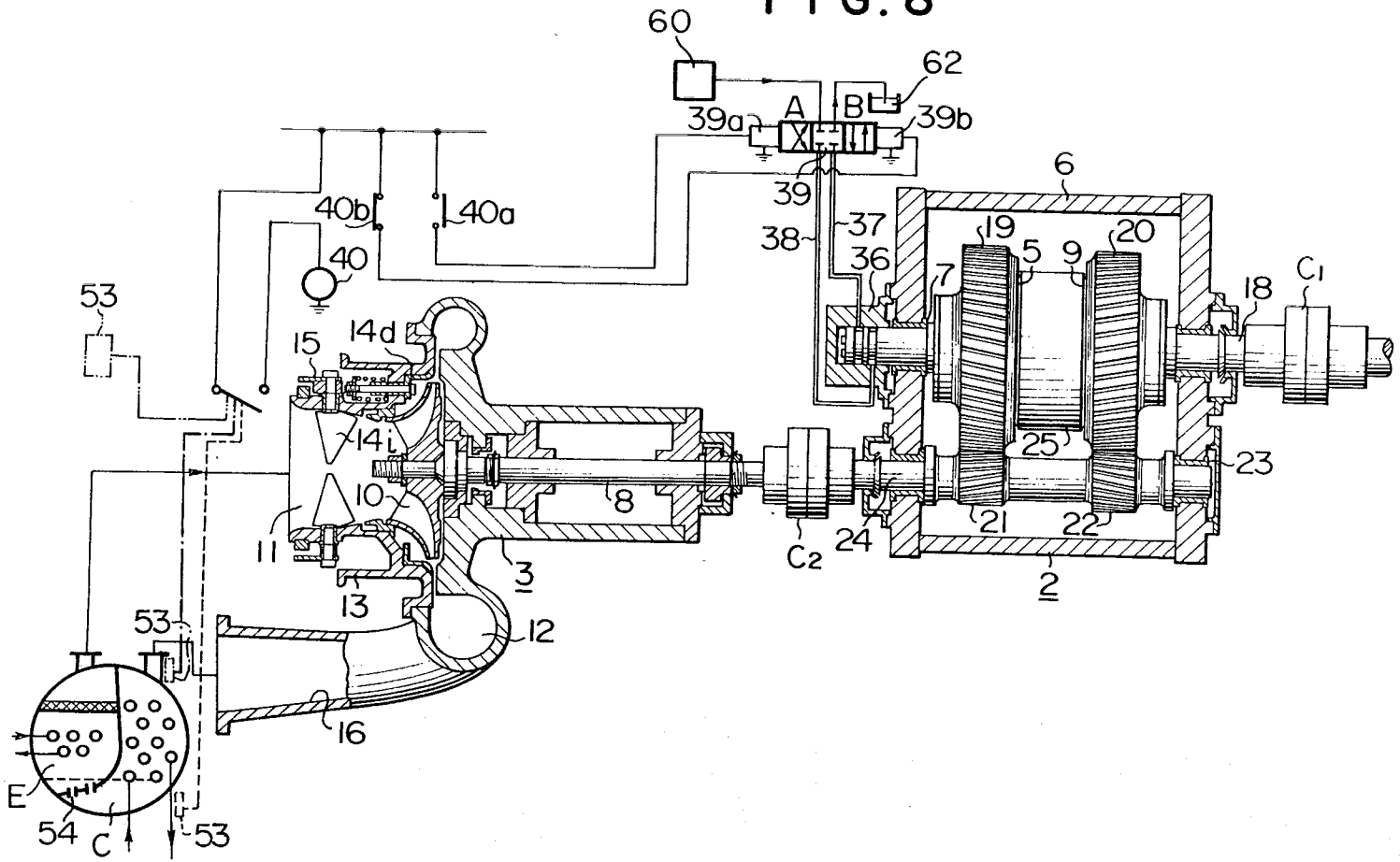
FIG. 8 is a fragmentary schematic sectional view of another embodiment applied to a fluid pressure raising system including an evaporator and a condenser.

FIG. 8 shows an apparatus in accordance with the invention adapted for controlling the operation of a fluid pressure raising system including, in addition to the motor and the compressor as shown in FIG. 1, a condenser C having a gas inlet connected to the discharge passage 16 of the compressor 3 and an outlet for the liquefied gas, an evaporator E having an inlet connected to the outlet of the condenser C and an outlet connected to the suction passage 11 of the compressor 3, and a reducing valve 54 such as a float valve or an expansion valve disposed between the outlet of the condenser C and the inlet of the evaporator E.

The condenser C has a cooling water inlet through which the cooling water is introduced to the water side of the condenser, and a cooling water outlet through which the cooling water is discharged. The evaporator E is provided with an inlet and outlet for brine, by means of which the brine is circulated through the evaporator.

The operation controlling apparatus as shown in FIG. 8 has a detector 53 which is associated with the condenser C to produce a signal representative of the cooling water temperature of the condenser C. An acutator adapted to be operated in response to this signal is identical with that of the first embodiment and, therefore, is not detailed here. Instead of detecting the cooling water temperature of the condenser C as stated above, the detector 53 may detect the pressure of the gas at the gas inlet of the condenser C communicating the discharge passage 16 of the compressor 3, as shown by the one-dot-and-dash line or, alternatively, the ambient air temperature around the pressure raising system as shown by two-dots-and-dash line.

In the foregoing description of the embodiments, the switching of the operation mode from set overdrive ratio operation to the low overdrive ratio operation and vice versa is performed automatically in association with the output from pressure detector or the temperature detector. However, it is possible to effect the switching of the operation mode manually, in accordance with the value of at least one of the pressure and temperature and the opening degree of the inlet vanes which are indicated by suitable indicating means.

As has been described in detail, the apparatus in accordance with the invention, which changes the overdrive ratio of overdrive gear in accordance with the discharge pressure of the compressor, affords the operation of the fluid pressure raising system at the maximum working efficiency in response to the change of the required discharge pressure, greatly contributing to the reduction of the energy required for the operation of the system.

In addition, the apparatus of the invention has quite a simple construction consisting of a pressure detector and a clutch adapted to select, in accordance with the output from the pressure detector, one gear train out of a plurality of gear trains having different overdrive ratios, so as to provide a less expensive centrifugal fluid machine.

What is claimed is:

1. An apparatus for controlling the operation of a fluid pressure raising system including at least a motor having a constant rotational speed and a centrifugal fluid machine connected to said motor, said centrifugal fluid machine including a casing provided with a suction passage and a discharge passage, inlet guide vanes disposed in said suction passage, an impeller shaft connected to said motor and rotatably mounted in said casing and at least one impeller carried by said impeller shaft, so that a fluid may be sucked through said suction passage and pressurized by said impeller as said impeller is driven by said motor and then discharged through said discharge passage, said apparatus comprising:

an overdrive gear having a variable overdrive ratio and disposed between said motor and said centrifugal fluid machine, said overdrive gear including a gear box, a driven shaft connected to said impeller shaft of said centrifugal fluid machine and rotatably carried by said gear box, at least two pinions having different numbers of gear teeth and carried by said driven shaft, a drive shaft extending substantially in parallel with said driven shaft and rotatably carried by said gear box, said drive shaft being connected to said motor, gears rotatably carried by said drive shaft and adapted to engage their respective corresponding pinions, and clutch means adapted to connect selected one of said gears to said drive shaft, whereby said driven shaft is rotated at least at two overdrive ratios of a set overdrive ratio and a low overdrive ratio;

detecting means for detecting a condition of said fluid pressure raising system to produce a signal representative of said condition; and an actuator for actuating said clutch means in response to said signal delivered by said detecting means, said fluid pressure raising system further includes a condenser having an inlet communicating said discharge passage and an outlet, and an evaporator having an inlet communicating said outlet of said condenser and an outlet communicating said suction passage, and wherein said detecting means detects the pressure at said inlet of said condenser.

2. An apparatus for controlling the operation of a fluid pressure raising system including at least a motor having a constant rotational speed and a centrifugal fluid machine connected to said motor, said centrifugal fluid machine including a casing provided with a suction passage and a discharge passage, inlet guide vanes disposed in said suction passage, an impeller shaft connected to said motor and rotatably mounted in said casing and at least one impeller carried by said impeller shaft, so that a fluid may be sucked through said suction passage and pressurized by said impeller as said impeller is driven by said motor and then discharged through said discharge passage, said apparatus comprising:

an overdrive gear having a variable overdrive ratio and disposed between said motor and said centrifugal fluid machine, said overdrive gear including a gear box, a driven shaft connected to said impeller shaft of said centrifugal fluid machine and rotatably carried by said gear box, at least two pinions having different numbers of gear teeth and carried by said driven shaft, a drive shaft extending substantially in parallel with said driven shaft and rotatably carried by said gear box, said drive shaft being connected to said motor, gears rotatably carried by said drive shaft and adapted to engage their respective corresponding pinions, and clutch means adapted to connect selected one of said gears to said drive shaft, whereby said driven shaft is rotated at least at two overdrive ratios of a set overdrive ratio and a low overdrive ratio;

detecting means for detecting a condition of said fluid pressure raising system to produce a signal representative of said condition; and an actuator for actuating said clutch means in response to said signal delivered by said detecting means, said fluid pressure raising system further includes a condenser having an inlet communicating said discharge passage and an outlet, and an evaporator having an inlet communicating said outlet of said condenser and an outlet communicating said suction passage, wherein said detecting means is adapted to detect the cooling water temperature of said condenser.

3. An apparatus for controlling the operation of a fluid pressure raising system including at least a motor having a constant rotational speed and a centrifugal fluid machine connected to said motor, said centrifugal fluid machine including a casing provided with a suction passage and a discharge passage, inlet guide vanes disposed in said suction passage, an impeller shaft connected to said motor and rotatably mounted in said casing and at least one impeller carried by said impeller shaft, so that a fluid may be sucked through said suction passage and pressurized by said impeller as said impeller is driven by said motor and then discharged through said discharge passage, said apparatus comprising:

an overdrive gear having a variable overdrive ratio and disposed between said motor and said centrifugal fluid machine, said overdrive gear including a gear box, a driven shaft connected to said impeller shaft of said centrifugal fluid machine and rotatably carried by said gear box, at least two pinions having different numbers of gear teeth and carried by said driven shaft, a drive shaft extending substantially in parallel with said driven shaft and rotatably carried by said gear box, said drive shaft being connected to said motor, gears rotatably carried by said drive shaft and adapted to engage their respective corresponding pinions, and clutch means adapted to connect selected one of said gears to said drive shaft, whereby said driven shaft is rotated at least two overdrive ratios of a set overdrive ratio and a low overdrive ratio;

detecting means for detecting a condition of said fluid pressure raising system to produce a signal representative of said condition; and an actuator for actuating said clutch means in response to said signal delivered by said detecting means, said fluid pressure raising system further includes a condenser having an inlet communicating said discharge passage and an outlet, and an evaporator having an inlet communicating said outlet of said condenser and an outlet communicating said suction passage, wherein said detecting means detects the ambient air temperature around said fluid pressure raising system.

4. An apparatus for controlling the operation of a fluid pressure raising system as claimed in claim 1, 2 or 3, wherein the numbers of said pinion and said gears meshing with said pinions are two respectively.

5. An apparatus for controlling the operation of a fluid pressure raising system as claimed in claim 1, 2 or 3, wherein said motor is a three-phase induction motor.

6. An apparatus for controlling the operation of a fluid pressure raising system as claimed in claim 1, 2 or 3, wherein said clutch means includes: a drive disc fixed to said drive shaft coaxially with the latter, said driven disc defining a pair of mutually opposing cylinders in cooperation with the outer peripheral surface of said drive shaft; pistons slidably received in said cylinders, respectively; a first group of discs associated with one of said gears and rotatable along with said one of said gears, said first group of discs being movable in the axial direction; a second group of discs associated with the other one of said gears and rotatable with said other one of said gears, said second group of discs being movable in the axial direction; a third group of discs associated with said drive shaft to rotate together with the latter and movable in the axial direction, the discs of said first and third groups being disposed alternatingly; and a fourth group of discs associated with said drive shaft to rotate together with the latter and movable in the axial direction, the discs of said second and fourth groups being disposed alternatingly; wherein a pressurized working fluid is normally introduced into one of said cylinders to displace the associated one of said pistons, thereby to bring the discs of said first and third groups into frictional engagement to allow the torque of said drive shaft to be transmitted to said one of said gears, while, when said working fluid is introduced into said one of said cylinders, the other of said cylinders is released from the pressure of said working fluid to keep the discs of said second group out of frictional engagement with the discs of said fourth group.

7. An apparatus for controlling the operation of a fluid pressure raising system as claimed in claim 1, 2 or 3, wherein said actuator includes a source for said working fluid, conduit means for making said pair of cylinders communicate with said source and a valve disposed in said conduit means, said valve being adapted to allow said working fluid from said source to come into one of said cylinders, and to allow said working fluid, in response to the signal from said detecting means, to come into the other of said cylinders while releasing said one of said cylinders from the pressure of said working fluid.

8. An apparatus for controlling the operation of a fluid pressure raising system as claimed in claim 1, 2 or 3, wherein said fluid pressure raising system further includes a restricting means disposed between said outlet of said condenser and said inlet of said evaporator.

9. An apparatus for controlling the operation of a fluid pressure raising system including at least a motor having a constant rotational speed and a centrifugal fluid machine connected to said motor, said centrifugal fluid machine including a casing provided with a suction passage and a discharge passage, inlet guide vanes disposed in said suction passage, an impeller shaft connected to said motor and rotatably mounted in said casing and at least one impeller carried to said impeller shaft, so that a fluid may be sucked through said suction passage and pressurized by said impeller as said impeller is driven by said motor and then discharged through said discharge passage, said apparatus comprising:

an overdrive gear having a variable overdrive ratio and disposed between said motor and said centrifugal fluid machine, said overdrive gear including a gear box, a driven shaft connected to said impeller shaft of said centrifugal fluid machine and rotatably carried by said gear box, at least two pinions having different numbers of gear teeth and carried by said driven shaft, a drive shaft extending substantially in parallel with said driven shaft and rotatably carried by said gear box, said drive shaft being connected to said motor, gears rotatably carried by said drive shaft and adapted to engate their respective corresponding pinions, and clutch means adapted to connect selected one of said gears to said drive shaft, whereby said driven shaft is rotated at least at two overdrive ratios of a set overdrive ratio and a low overdrive ratio;

detecting means for detecting an extrinsic property of the fluid pumped in said fluid pressure raising system so as to produce a signal representative of said extrinsic property; and an actuator for actuating said clutch means in response to said signal delivered by said detecting means.

10. An apparatus for controlling the operation of a fluid pressure raising system including at least a motor having a constant rotational speed and a centrifugal fluid machine connected to said motor, said centrifugal fluid machine including a casing provided with a suction passage and a discharge passage, inlet guide vanes disposed in said suction passage, an impeller shaft connected to said motor and rotatably mounted in said casing and at least one impeller carried by said impeller shaft, so that a fluid may be sucked through said suction passage and pressurized by said impeller as said impeller is driven by said motor and then discharged through said discharge passage, said apparatus comprising:

an overdrive gear having a variable overdrive ratio and disposed between said motor and said centrifugal fluid machine, said overdrive gear including a gear box, a driven shaft connected to said impeller shaft of said centrifugal fluid machine and rotatably carried by said gear box, at least two pinions having different numbers of gear teeth and carried by said driven shaft, a drive shaft extending substantially in parallel with said driven shaft and rotatably carried by said gear box, said drive shaft being connected to said motor, gears rotatably carried by said drive shaft and adapted to engage their respective corresponding pinions, and clutch means adapted to connect selected one of said gears to said drive shaft, whereby said driven shaft is rotated at least at two overdrive ratios of a set overdrive ratio and a low overdrive ratio;

detecting means for detecting an extrinsic condition which varies the discharge pressure of said centrifugal fluid machine to produce a signal; and an actuator operative in response to said signal delivered by said detecting means to actuate said clutch means so as to cause the same to select said low overdrive ratio from said at least two overdrive ratios of said overdrive gear when a value detected by said detecting means is lower than a pre-set reference valve and so as to cause said clutch means to select said set overdrive ratio from said at least two overdrive ratios of said overdrive gear when the detected value is higher than the pre-set reference value.

11. An apparatus for controlling the operation of a fluid pressure raising system as claimed in claims 9 or 10, wherein said motor is a three-phase induction motor.

12. An apparatus for controlling the operation of a fluid pressure raising system as claimed in claim 9 or 10, wherein said detecting means detects the pressure in said discharge passage.

13. An apparatus for controlling the operation of a fluid pressure raising system including at least a motor having a constant rotational speed and centrifugal fluid machine connected to said motor, said centrifugal fluid machine including a casing provided with a suction passage and a discharge passage, inlet guide vanes disposed in said suction passage, an impeller shaft connected to said motor and rotatably mounted in said casing and at least one impeller carried by said impeller shaft, so that a fluid may be sucked through said suction passage and pressurized by said impeller as said impeller is driven by said motor and then discharged through said discharge passage, said apparatus comprising:

an overdrive gear having a variable overdrive ratio and disposed between said motor and said centrifugal fluid machine, said overdrive gear including a gear box, a driven shaft connected to said impeller shaft of said centrifugal fluid machine and rotatably carried by said gear box, at least two pinions having different numbers of gear teeth and carried by said driven shaft, a drive shaft extending substantially in parallel with said driven shaft and rotatably carried by said gear box, said drive shaft being connected to said motor, gears rotatably carried by said drive shaft and adapted to engage their respective corresponding pinions, and clutch means adapted to connect selected one of said gears to said drive shaft, whereby said driven shaft is rotated at least at two overdrive ratios of a set overdrive ratio and a low overdrive ratio;

detecting means for detecting any one of an extrinsic condition which varies the discharge pressure of said centrifugal fluid machine and which varies the discharge pressure per se to produce a signal; and an actuator operative in response to said signal delivered by said detecting means to actuate said clutch means so as to cause the same to select said low overdrive ratio from said at least two overdrive ratios of said overdrive gear when a value detected by said detecting means is lower than a pre-set reference value and so as to cause said clutch means to select said set overdrive gear when the detected value is higher than the pre-set reference value, wherein said detecting means detects the pressure in said discharge passage.

14. An apparatus for controlling the operation of a fluid pressure raising system including at least a motor having a constant rotational speed and a centrifugal fluid machine connected to said motor, said centrifugal fluid machine including a case provided with a suction passage and a discharge passage, inlet guides vanes disposed in said suction passage, an impeller shaft connected to said motor and rotatably mounted in said casing and at least one impeller carried by said impeller shaft, so that a fluid may be sucked through said suction passage and pressurized by said impeller as said impeller is driven by said motor and then discharged through said discharge passage, said apparatus comprising:

an overdrive gear having a variable overdrive ratio and disposed between said motor and said centrifugal fluid machine, said overdrive gear including a gear box, a driven shaft connected to said impeller shaft of said centrifugal fluid machine and rotatably carried by said gear box, at least two pinions having different numbers of gear teeth and carried by said driven shaft, a drive shaft extending substantially in parallel with said driven shaft and rotatably carried by said gear box, said drive shaft being connected to said motor, gears rotatably carried by said drive shaft and adapted to engage their respective corresponding pinions, and clutch means adapted to connect selected one of said gears to said drive shaft, whereby said driven shaft is rotated at least at two overdrive ratios of a set overdrive ratio and a low overdrive ratio;

detecting means for detecting a condition of said fluid pressure raising system to produce a signal representative of said condition; and an actuator for actuating said clutch means in response to said signal delivered by said detecting means.

15. An apparatus for controlling the operation of a fluid pressure raising system as claimed in claim 14, wherein said motor is a three-phase induction motor.

16. An apparatus for controlling the operation of a fluid pressure raising system including at least a motor having a constant rotational speed and a centrifugal fluid machine connected to said motor, said centrifugal fluid machine including a casing provided with a suction passage and a discharge passage, inlet guide vanes disposed in said suction passage, an impeller shaft connected to said motor and rotatably mounted in said casing and at least one impeller carried by said impeller shaft, so that fluid may be sucked through said suction passage and pressurized by said impeller as said impeller is driven by said motor and then discharged through said discharge passage, said apparatus comprising:

an overdrive gear having a variable overdrive ratio and disposed between said motor and said centrifugal fluid machine, said overdrive gear including a gear box, a driven shaft connected to said impeller shaft of said centrifugal fluid machine and rotatably carried by said gear box, at least two pinions having different numbers of gear teeth and carried by said driven shaft, a drive shaft extending substantially in parallel with said driven shaft and rotatably carred by said gear box, said drive shaft being connected to said motor, gears rotatably carried by said drive shaft and adapted to engage their respective corresponding pinions, and clutch means adapted to connect selected one of said gears to said drive shaft, whereby said driven shaft is rotated at least at two overdrive ratios of a set overdrive ratio and a low overdrive ratio;

detecting means for detecting a condition of said fluid pressure raising system to produce a signal representative of said condition, and an actuator for actuating said clutch means in response to said signal delivered by said detecting means, wherein said detecting means detects the pressure in said discharge passage.

17. An apparatus for controlling the operation of a fluid pressure raising system as claimed in claim 1, 2, 3, 9, or 10, wherein the numbers of said pinions and said gears are two.

18. An apparatus for controlling the operation of a fluid pressure raising system as claimed in claim 4, wherein said clutch means includes: a drive disc fixed to said drive shaft coaxially with the latter, said drive disc defining a pair of mutually opposing cylinders in cooperation with the outer peripheral surface of said drive shaft; pistons slidably received in said cylinders, respectively; a first group of discs associated with one of said gears and rotatable along with said one of said gears, said first group of discs being movable in the axial direction; a second group of discs associated with the other one of said gears and rotatable with said other one of said gears, said second group of discs being movable in the axial direction; a third group of discs associated with said drive shaft to rotate together with the latter and movable in the axial direction, the discs of said first and third groups being disposed alternatingly; and a fourth group of discs associated with said drive shaft to rotate together with the latter and movable in the axial direction, the discs of said second and fourth groups being disposed alternatingly; wherein a pressurized working fluid is normally introduced into one of said cylinders to displace the associated one of said pistons, thereby to bring the discs of said first and third groups into frictional engagement to allow the torque of said drive shaft to be transmitted to said one of said gears, while, when said working fluid is introduced into said one of said cylinders, the other of said cylinders is released from the pressure of said working fluid to keep the discs of said second group out of frictional engagement with the discs of said fourth group.

19. An apparatus for controlling the operation of a fluid pressure raising system as claimed in claim 18, wherein said actuator includes a source for said working fluid, conduit means for making said pair of cylinders communicate with said source and a valve disposed in said conduit means, said valve being adapted to allow said working fluid from said source to come into one of said cylinders, and to allow said working fluid, in response to the signal from said detecting means, to come into the other of said cylinders while releasing said one of said cylinders from the pressure of said working fluid.

20. An apparatus for controlling the operation of a fluid pressure raising system as claimed in claim 19, wherein said detecting means includes a switch adapted to be kept opened in the normal state in which the pressure in said discharge passage is lower than a predetermined threshold and opened as said threshold is reached, while said valve is a solenoid-actuated four way valve having a pair of solenoid coils, and wherein said actuator has a relay operable in accordance with the status of said switch, said relay having a normally-opened contact and a normally-closed contact connected to respective one of said solenoid coils.

21. An apparatus for controlling the operation of a fluid pressure raising system as claimed in claim 20, further comprising means for preventing a hunting of said switch from taking place, said means for preventing the hunting including a first timer energized simultaneously with the energization of one of said solenoid coils of said solenoid-actuated four way valve, and to hold the energized state for a predetermined time length, said first timer having an instantaneous normally-closed contact and an instantaneous normally-opened contact, said means for preventing the hunting further including a second timer energized simultaneously with the energization of the outer of said solenoid coil and to hold the energized state for a predetermined time length, said second timer also having an instantaneous normally-closed contact and an instantaneous normally-opened contact, said instantaneous normally-closed contact of said first timer being connected in series between said normally-closed contact associated with said relay and said the other of said solenoid coil, said instantaneous normally-opened contact being connected in parallel with a series connection of said normally-opened contact associated with said relay and said instantaneous normally-closed contact of said second timer, said instantaneous normally-closed contact of said second timer being connected in series between said normally-opened contact associated with said relay and said the other of said solenoid coils, said instantaneous normally-opened contact of said second timer being connected in parallel with a series connection of said normally-closed contact associated with said relay and instantaneous normally-closed contact of said first timer.

22. An apparatus for controlling the operation of a fluid pressure raising system as claimed in claim 20, further comprising means for preventing said overdrive gear operated at said set overdrive ratio from being switched to said low overdrive ratio when the flow rate demand is large at an instant at which said overdrive gear is to be switched to said low overdrive ratio, said means for preventing the switching of said overdrive gear including a second switch which is adapted to be kept closed when the opening degree of said inlet vanes is between the full-opening and an opening degree in the set overdrive ratio operation corresponding to the flow rate attained by the low overdrive ratio operation with said inlet vanes opened fully and to be kept opened in the period other than that stated above, and a second relay operable in accordance with the status of said second switch and provided with a normally-opened contact and a normally-closed contact, said normally-opened contact of said second relay being connected in parallel with said normally-opened contact of the first-mentioned relay and in series to one of said solenoid coils, said normally-closed contact of said second relay being connected in series between the other solenoid coil and said normally-closed contact of the first-mentioned relay.

23. An apparatus for controlling the operation of a fluid pressure raising system as claimed in claim 1, 9 or 10, wherein said fluid pressure raising system further includes a condenser having an inlet communicating said discharge passage and an outlet, and an evaporator having an inlet communicating said outlet of said condenser and an outlet communicating said suction passage.

24. An apparatus as claimed in claim 1, 9 or 10, wherein said fluid pressure raising system further comprises another motor, and another centrifugal fluid machine driven by said another motor, said another centrifugal fluid machine having a casing provided with a suction passage and a discharge passage communicated with said suction passage, an impeller shaft connected to said another motor and mounted rotatably in said casing and at least one impeller carried by said impeller shaft, said suction and discharge passages of said another centrifugal fluid machine communicating, respectively, said suction and discharge passages of the first-mentioned centrifugal fluid machine, said impeller of said another centrifugal fluid machine being so designed as to provide the same pressure ratio as that performed by said impeller of the first-mentioned centrifugal fluid machine driven at said low overdrive ratio, said fluid pressure raising system further comprising another overdrive gear disposed between said another motor and said impeller shaft of said another centrifugal fluid machine.

25. An apparatus for controlling the operation of a fluid pressure raising system as claimed in claim 21, further comprising means for preventing said overdrive gear operated at said set overdrive ratio from being switched to said low overdrive ratio when the flow rate demand is large at an instant at which said overdrive gear is to be switched to said low overdrive ratio, said means for preventing the switching of said overdrive gear including a second switch which is adapted to be kept closed when the opening degree of said inlet vanes is between the full-opening and an opening degree in the set overdrive ratio operation corresponding to the flow rate attained by the low overdrive ratio operation with said inlet vanes opened fully and to be kept opened in the period other than that stated above, and a second relay operable in accordance with the status of said second switch and provided with a normally-opened contact and a normally-closed contact, said normally-opened contact of said second relay being connected in parallel with said normally-opened contact of the first-mentioned relay and in series to one of said solenoid coils, said normally-closed contact of said second relay being connected in series between the other solenoid coil and said normally-closed contact of the first-mentioned relay.

* * * * *